United States Patent [19]

Ryer et al.

[11] Patent Number: 4,532,062

[45] Date of Patent: Jul. 30, 1985

[54] ADDITIVE FOR POWER TRANSMISSION SHIFT FLUIDS

[75] Inventors: Jack Ryer, East Brunswick; Ricardo Bloch, Scotch Plains; Harold E. Deen, Cranford, all of N.J.

[73] Assignee: Exxon Research & Engineering Co., Florham Park, N.J.

[21] Appl. No.: 573,122

[22] Filed: Jan. 23, 1984

[51] Int. Cl.[3] ..... C10M 1/32; C07D 417/00

[52] U.S. Cl. ..... 252/78.1; 252/47; 544/135; 548/167

[58] Field of Search ..... 252/78.1, 47; 548/167; 544/135

[56] References Cited

U.S. PATENT DOCUMENTS 3,600,398 8/1971 Svarz et al. ..... 548/167
3,966,623 6/1976 Krug et al. ..... 252/47

FOREIGN PATENT DOCUMENTS 209595 2/1982 Czechoslovakia .

*Primary Examiner*—Paul Lieberman
*Assistant Examiner*—Robert A. Wax
*Attorney, Agent, or Firm*—John J. Mahon

[57] ABSTRACT

There are disclosed improved additives for power shift transmission fluids being amine or ammonium salts of mercaptobenzothiazole dissolved in excess amine. The additives are useful as corrosion inhibitors, anti-oxidants and friction modifiers.

5 Claims, No Drawings

ADDITIVE FOR POWER TRANSMISSION SHIFT FLUIDS

This invention relates to power transmission shift fluids, such as automatic transmission fluids, which contain an improved additive effective as corrosion inhibitor, oxidation inhibitor and friction modifier. More particularly this invention relates to amine or ammonium salts of mercaptobenzothiazole (MBT) which have been found to function as an improved additive in power transmission shift fluids.

MBT has been used in power transmission shift fluids such as automatic transmission fluid compositions as a corrosion inhibitor, however, difficulties have been encountered in effectively solubilizing the material into the composition. This often requires the use of special solvents and blending techniques to deal with with the compatibility problem. Materials such as hexyl phthalate have been used as special solvents for the MBT additive.

The present invention is based upon the discovery that certain amine or ammonium salts of MBT are highly effective additives and are readily blended into automatic transmission fluids and other functional fluid compositions. Such amine salts exhibit improved multifunctional additive properties not obtained with the heretofore used mercaptobenzothiazole.

In accordance with this invention, there have been discovered power shift transmission fluids comprising a major amount of a hydrocarbon mineral oil of lubricating viscosity and an effective oxidation and corrosion inhibiting and friction modifying amount of an additive being an amine or ammonium salt of mercaptobenzothiazole dissolved in excess amine, said salt being a product formed by reacting mercaptobenzothiazole with a normally liquid amine of the formula $R_1R_2R_3N$ at temperatures of 50°–80° C. using a molar excess of amine, wherein $R_1$ and $R_2$ may be hydrogen or lower alkyl and $R_3$ is an alkyl or mixture of alkyls each having about 6–20 carbon atoms. The additive is the amine or ammonium salt dissolved in the excess of unreacted amine.

Suitable amines are generally oil soluble primary, secondary and tertiary amines having up to about 25 carbon atoms and having one or more alkyl groups of at least about 6 carbon atoms. Particularly preferred for use in the present invention are tertiary alkyl primary amines wherein $R_1$ and $R_2$ are hydrogen and $R_3$ is a tertiary alkyl group of the formula $R_4R_5R_6C$— wherein $R_4$ and $R_5$ are lower $C_1$–$C_4$ alkyl, particularly methyl, and $R_6$ represents $C_{15}$–$C_{19}$ alkyl, preferably mixed branched $C_{15}$–$C_{19}$ alkyl groups or mixed branched $C_9$–$C_{11}$ alkyl groups.

Other suitable amines include dimethyl octadecyl amine, cocoamine, N,N-dimethyl-1-dodecanamine and N,N-dimethylcocomine.

To form the oil soluble additive of the present invention, MBT is combined with a molar excess of amine by heating at about 50° to 80° C. for time sufficient to form the amine or ammonium salt with the —SH moiety of MBT. The excess amine acts both as a solvent for the salt forming reaction and as a solvent for the additive product itself, the additive being the solution of MBT salt in excess unreacted amine. Preferred are molar ratios of about 1.2 to 1.5 moles of amine per mole of MBT but up to about 2 to 3 moles of amine per mole of MBT may be used.

The improved additive of the present invention offers a number of advantages. It is readily blended into and compatible with power transmission shift fluids such as automatic transmission fluids and exhibits the desirable anti-oxidation properties with respect to the fluid itself as well as effective corrosion inhibition properties for copper, brass and braze alloys (silver, phosphorous, tin) parts which are utilized in transmission mechanisms. Moreover, it has been found in accordance with this invention that the improved liquid amine salt additive also functions effectively as a friction modifier. This property is not exhibited by unmodified MBT, the utility of which was limited to corrosion inhibition.

Power shift transmission fluids will contain the liquid amine or ammonium MBT salt additive of the present invention in amounts of from 0.1 to 1 wt% and preferably in the range of about 0.2 to 0.5 wt%.

In addition to use in automatic transmission fluids the additive of the present invention will function as a corrosion and oxidation inhibitor and friction modifier in other power transmission shift fluids based upon mineral oils such as hydraulic fluids, power brake and power steering fluids, heavy duty equipment fluids, universal heavy duty oils for diesel powered equipment and the like.

Automatic transmission fluids containing the additive of the present invention are the preferred embodiment. Such ATF compositions contain a number of conventional additives in amounts providing their normal attendant functions that are typically blended into a mineral oil base in the following ranges:

| Components | Concentration Range (Vol. %) |
|---|---|
| V.I. Improver | 1–15 |
| Corrosion Inhibitor | 0.01–1 |
| Oxidation Inhibitor | 0.01–1 |
| Dispersant | 0.5–10 |
| Pour Point Depressant | 0.01–1 |
| Demulsifier | 0.001–0.1 |
| Anti-Foaming Agents | 0.001–0.1 |
| Anti-Wear Agents | 0.001–1 |
| Seal Swellant | 0.1–5 |
| Friction Modifier | 0.01–1 |
| Mineral Oil Base | Balance |

Typical base oils for automatic transmission fluids and power transmission shift fluids generally include a wide variety of light hydrocarbon mineral oils, such as, naphthenic base, paraffin base and mixtures thereof, having a lubricating viscosity range of about 34 to 45 Saybolt Universal Seconds at 38° C.

The invention is further illustrated by the following examples which are not to be considered as limitative of its scope. ATF compositions used in the examples below were formulated in accordance with the components (except corrosion and oxidation inhibitor and friction modifier where the additive of this invention was used and evaluated for these properties as indicated) and concentrations noted above and are referred to as Base Fluid.

EXAMPLE 1

A liquid additive was prepared by reacting 0.15 moles of mercaptobenzothiazole and 0.25 moles of a t-alkyl primary amine of the formula $(CH_3)_2RCNH_2$, where R represents mixed branched $C_{15}$–$C_{19}$ alkyl radicals, at 80° C. to form a liquid solution of amine salt in excess amine. The product was a stable, homogeneous liquid and was readily soluble and miscible with a formulated automatic transmission fluid corresponding to the Base Fluid described above.

EXAMPLE II

To a formulated automatic transmission fluid (Base Fluid) was added 0.2 wt% of the amine salt additive of Example I and the fluid was evaluated for its required anti-corrosion properties and anti-oxidation properties.

Copper and brass corrosion tests were conducted which comprised immersing copper and brass specimens $3\times\frac{1}{2}\times 1/6$ inches weighed to 0.1 milligram in 40 cc. of the Base Fluid and maintaining the specimens in the fluid at 300° F. for 65 hours. Thereafter the specimens are washed in hexane, rubbed to remove any loose deposits and reweighed. The results were 21.4 mg copper loss and 2.9 mg brass loss. These results satisfy current commercial specifications for automatic transmission fluids such as the General Motors Corp. Dexron® II specifications for ATF.

The fluid of the Example containing the amine salt additive of this invention was also evaluated in accordance with the General Motors Corp. Turbo Hydra Matic Oxidation Test (THOT) (Specification GM 6137-M) which evaluates sludge or varnish deposits, oxidation by increase in TAN (Total Acid Number) and by increase in IR carbonyl group absorbance, copper corrosion and braze alloy cooler corrosion. The results are as follows: Sludge, Pass; $\Delta TAN=2.66$; $\Delta IR=0.42$ copper, 96 ppm, Cooler Corrosion, Pass. These results satisfy the THOT requirements and indicate the corrosion and oxidation inhibiting effect of the additive of this invention.

EXAMPLE III

Another liquid amine additive was prepared by reacting one mole of MBT with 1.2 to 2 moles of a t-alkyl primary amine of the formula $(CH_3)_2RCNH_2$ where R represents mixed branch chain alkyl radicals containing 9 to 11 carbon atoms. This was prepared in a manner of Example I.

EXAMPLE IV

To a formulated ATF Base Fluid was added 0.21% of the additives of Example III. Brass and copper corrosion test were conducted which showed 28 mg copper loss and 0 mg brass loss.

This fluid was also subjected to the General Motors THOT evaluation with the following results: Sludge, Pass; $\Delta TAN$ 4.0; $\Delta IR=0.49$; Copper, 93 ppm Cooler Corrosion, Pass. These results also satisfy the THOT requirements for an automatic transmission fluid.

EXAMPLE V

The friction modification properties of the additives of this invention were demonstrated by adding 0.23 wt% of the additive prepared in Example I for a formulated SAE quality universal heavy duty oil for diesel equipment transmissions which contained conventional amounts of dispersant, metal detergent additives, zinc, antiwear additives, viscosity index improver and antioxidant. This oil successfully passed the Allison C-3 Friction Retention Test, which utilizes an SAE-2 friction machine which must operate successfully in accordance with the test for a period of 50 hours with maximum slip less than 50 seconds, the torque at 0.2 seconds must be a minimum of 75 ft.-pounds and the decrease in torque during the test (1500–5500 cycles) must be less than 30 ft. lbs. Unmodified MBT will not pass this test and will not function effectively as a friction modifier.

What is claimed is:

1. A power shift transmission fluid composition comprising a major amount of hydrocarbon mineral oil of lubricating viscosity and an effective oxidation and corrosion inhibiting and friction modifying amount of an additive being an amine or ammonium salt of mercaptobenzothiazole dissolved in a molar excess of amine, said salt being formed by reacting mercaptobenzothiazole with a molar excess of a liquid amine, said excess being about 1.2 to 3 moles of amine per mole of mercaptobenzothiazole, the amine having the formula $R_1R_2R_3N$ at 50°–80° C. when $R_1$ and $R_2$ may be hydrogen or lower $C_1$–$C_4$ alkyl and $R_3$ is a $C_6$–$C_{20}$ alkyl.

2. A composition according to claim 1 wherein $R_1$ and $R_2$ are hydrogen and $R_3$ is a tertiary alkyl group of the formula $R_4R_5R_6C$— wherein $R_4$ and $R_5$ are methyl and $R_6$ represents either $C_{15}$–$C_{20}$ or $C_9$–$C_{11}$ mixed branched alkyl groups.

3. The composition of claim 2 wherein there is present 0.2 to 0.5 wt% of said additive.

4. The composition of claim 1 wherein said power shift transmission fluid is an automatic transmission fluid.

5. The composition of claim 1 wherein said power shift transmission fluid is a universal heavy duty diesel oil.

* * * * *